United States Patent [19]

Baclagis

[11] Patent Number: 4,590,874

[45] Date of Patent: May 27, 1986

[54] TENSION REGULATOR FOR ELASTIC TAPE AND THE LIKE, PARTICULARLY IN SEWING MACHINES ADAPTED TO ATTACH TAPE TO A WORKPIECE

[75] Inventor: Luca Baclagis, Maranello, Italy

[73] Assignee: Ram Elettronica di Baclagis Luca & C. S.n.c., Modena, Italy

[21] Appl. No.: 639,694

[22] Filed: Aug. 13, 1984

[30] Foreign Application Priority Data

Dec. 30, 1983 [IT] Italy ..... 40132 A/83

[51] Int. Cl.[4] ..... D05B 21/00

[52] U.S. Cl. ..... 112/121.26; 112/121.27; 112/305

[58] Field of Search ..... 112/121.26, 121.27, 112/318, 305, 121.11, 121.12

[56] References Cited

U.S. PATENT DOCUMENTS

| | | | |
|---|---|---|---|
| 3,847,099 | 11/1974 | Braun | 112/121.26 X |
| 4,248,170 | 2/1981 | Adamski et al. | 112/121.26 |
| 4,303,027 | 12/1981 | Uemura et al. | 112/121.26 |
| 4,462,326 | 7/1984 | Perego et al. | 112/318 |
| 4,475,474 | 10/1984 | von Hagen et al. | 112/121.26 |

*Primary Examiner*—H. Hampton Hunter

*Attorney, Agent, or Firm*—Kuhn Muller and Bazerman

[57] ABSTRACT

The invention pertains to a tension regulator for elastic tape and the like, particularly in sewing machines adapted to attach tape to a workpiece.

This regulator substantially consists of an electromechanical transducer on which the stress produced by tensioning the tape causes a mechanical deformation converted into an electrical signal; this electrical signal, suitably processed, controls a motor means which acts so as to feed or take up tape in order to keep the tension of the same at a constant value.

8 Claims, 5 Drawing Figures

TENSION REGULATOR FOR ELASTIC TAPE AND THE LIKE, PARTICULARLY IN SEWING MACHINES ADAPTED TO ATTACH TAPE TO A WORKPIECE

BACKGROUND OF THE INVENTION

1. Field of the Invention

The present invention pertains to a tension regulator for elastic tape and the like, particularly in sewing machines adapted to attach tape to a workpiece.

2. Prior Art

When garment workpieces such as bathing costumes, underclothes and the like have to be made, it is rather usual that the finished workpiece needs to be pleated at different points; these pleats are generally obtained by stitching the material forming the garment workpiece on an elastic pre-tensioned tape or the like. In this manner, once the tape has taken its natural position again, the material stitched on said tensioned tape appears pleated proportionately to the tensioning of the tape during the stitching operation.

Normally the pre-tensioning of the tape is directly carried out by the operator acting manually on the tape; however this procedure depends greatly upon the dexterity of the operator and in any way it often gives rise to different results in different workpieces.

A device is also known for adjusting the tensioning of these tapes, substantially comprising a pair of knurled rollers between which the tape is caused to pass; these knurled rollers are moved by means of a free wheel device operated by a connecting rod, so as to adjust the feeding of tape to the pressing foot of the machine.

However this device can only effect activation in order to reduce the tensioning of the tape (in fact it is not in a position to take up tape, should the tensioning of the latter become slacker) and it also has further drawbacks. it is not responsive to variations in tape elasticity, so that, if the tape—due to defects in manufacture or the like—exhibits portions of greater or lesser elasticity than usually, it cannot adjust the tensioning of the tape based on a predetermined it, value. it also gives rise to difficulties when the predetermined tape-tensioning value has to be adjusted or when some values must be repeated owing to the fact that said adjustment is obtained by regulating the length of the connecting rod actuating the knurled rollers, a long and arduous operation. It also varies according to the type of tape used; and each time the sewing machine stops, the length of tape situated between the knurled roller and the presser foot of the sewing machine becomes unusable as it is no more possible to adjust the tensioning thereof.

Furthermore said device is rather bulky and is usually located close to the sewing machine's presser foot so that it interferes with the operator's work and reduces his visibility.

OBJECTS

It is therefore an object of the present invention to eliminate the above mentioned drawbacks and to provide a tension regulator having the following advantages:

allowing to increase or to reduce the tape tensioning so that it is always kept at a predetermined value;

being not subjected to the consequences of a possible local variation in elasticity by the tape, being suitable to be readily set to a determined tape-tensioning value;

allowing the repetition of the set value without any difficulties;

keeping the tape-tensioning value unchanged even in the case of stopping of the sewing machine, being suitable to be applied to a sewing machine without hampering the operator while working at the same;

being suitable to be directly controlled by an electronic processor which automatically interprets and executes the instructions for carrying out the pleating and stitching operations.

It is a further object of the present invention to provide a tension regulator reaching a very high degree of accuracy independent of the position of the tape with respect to the regulator itself and having a very reduced need of servicing.

SUMMARY OF THE INVENTION

These and still further objects are achieved by the tension regulator of the invention, particularly in sewing machines adapted to attach tape to a workpiece, comprising: a pulley fitted to rotate about its own axis, located along the track of the tape between a tape feeding bobbin and the sewing machine's presser foot and on part of the circumference of which said tape is wound during its travel; an electromechanical transducer to which the axis of rotation of said pulley is integrally connected and on which the stress caused by the tension of the tape acts, which is adapted to convert the deformation produced by said stress on its mechanical part into an electric signal; motor means suitable to drivingly increase or reduce the feed of tape to said presser foot, with respect to the normal feed depending upon the request of the sewing machine; an electric comparator suitable to compare said electric signal with a preselected reference signal and to deliver a command; processing means of a known type adapted to convert said command into a driving signal for said motor means.

Further features and advantages of the invention will become more apparent from the following detailed description of preferred embodiments of the tension regulator in question given hereinafter by way of example only with reference to the accompanying drawings.

DESCRIPTION OF THE PREFERRED EMBODIMENTS OF THE INVENTION

Figure 1:
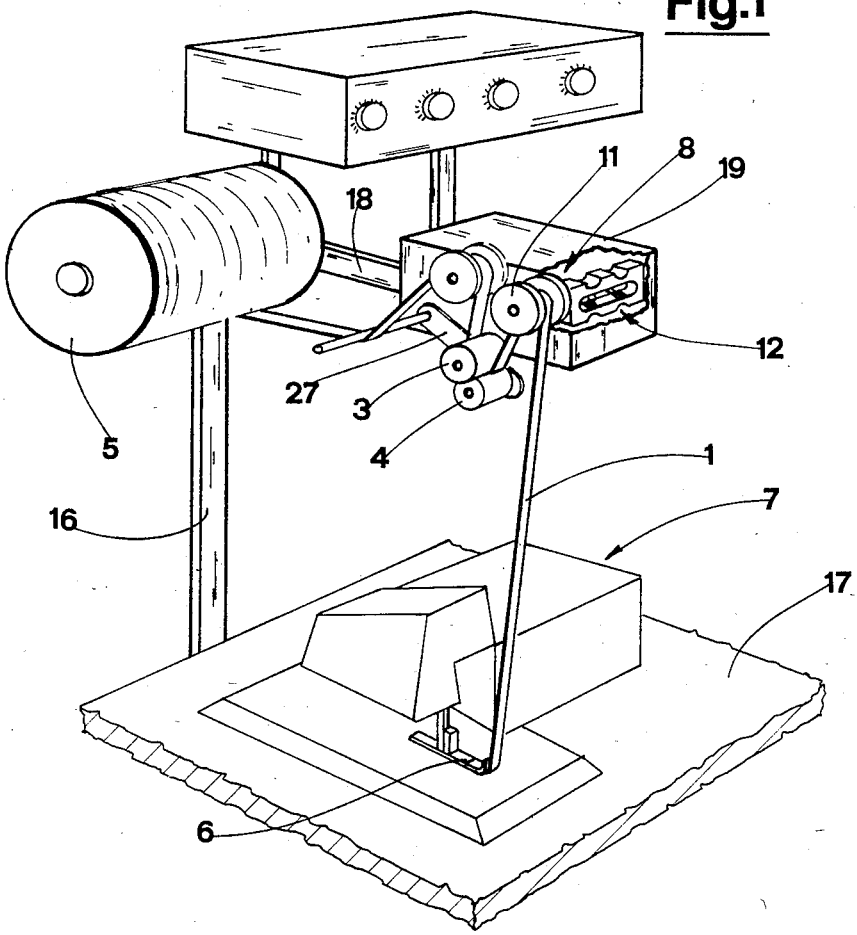
FIG. 1 is a perspective view of a first embodiment of the regulator of the invention applied to a sewing machine shown diagrammatically.

The regulator according to the invention is applied to a sewing machine 7 for attaching elastic tape 1 to a workpiece not shown in the figures. This regulator comprises a pulley 11 located along the track of the tape between a tape feed bobbin 5 and the presser foot 6 of the sewing machine; during its travel the tape is wound on part of the circumference of said pulley 11.

The stress caused by the tension of the tape is discharged on a bar 12 of an electromechanical transducer 8; in fact the axis of rotation of the pulley is integrally connected to the free end of the bar the other end of which is fixedly restrained within the regulator body 19.

Bar 12 consists of four portions that are rigid when submitted to bending stresses, i.e. a portion 31 fixedly restrained within the body of the regulator, an upper portion 32, a portion 33 to which the axis of rotation of the pulley is connected and a lower portion 34; these portions are connected to each other by means of four further portions, 35, 36, 37 and 38 respectively, that are elastic when submitted to bending stresses. An electrical straingauge 15 (or another equivalent device such as for example a differential transformer) is provided on each of said elastic portions, which detects the deformations of the corresponding elastic portion of the bar and converts them into an electric signal. The signals of the different strain gauges are algebraically summed up so that they give an electrical output signal from the electromechanical transducer, which is proportional to the deformation caused by the force exerted by the tape on the bar. The bar acts as an articulated quadrilateral so that the electrical output signal from the transducer is independent of the distance of the tape with respect to the portion of bar fixedly restrained; it is therefore avoided that, owing to shiftings of the tape towards the pulley axis, with respect to the pulley itself, the electrical output signals from the transducer may be different for identical tension values of the tape. Furthermore, the necessity of adjusting the device according to the different widths of the tape is avoided.

In order to avoid the axial shifting of the tape within the pulley race which could in any case involve some difficulties in stitching, it has been envisaged that the pulley might be provided with a slidable flank 13 moving in an axial direction in order to allow to vary the width of the pulley race.

The regulator also comprises motor means intended to drivingly increase or reduce the feeding of tape to the presser foot with respect to the normal feeding depending upon the request from the sewing machine's presser foot.

According to one embodiment, said motor means comprises a pair of rollers 3 and 4 disposed along the track of the tape between bobbin 5 and pulley 11, which are urged into contact with each other and between which the tape is caused to pass; roller 3 is drivingly actuated by an electric motor and eventually by a reduction gear, both housed in the regulator body 19 and therefore not shown in the figures; roller 4 is idly supported by a rod 27 articulated to body 19 and is urged into contact with roller 3 by a return spring 26. A guide pulley 28 is also provided which is fastened to the body 19 of the regulator.

According to a second embodiment, said motor means consists of an electric motor 14 integrally connected to bar 12 and to the shaft of which pulley 11 is integrally connected. This solution can be adopted when the motor is not very heavy; should not this be the case, it is possible to connect the motor to the body of the regulator and operate pulley 11 through an articulated drive.

Obviously, in this case a roller 11a is provided which must be pressed against pulley 11; tape will be held pressed against the pulley by this roller.

Figure 2:
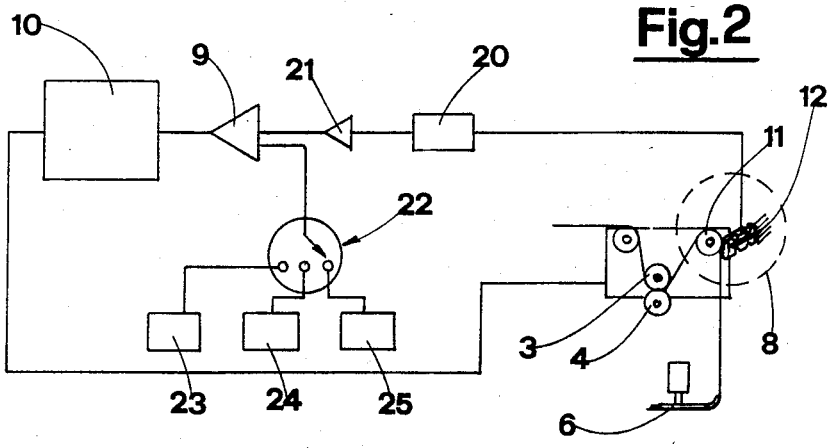
FIG. 2 is a block diagram of a possible accomplishment of the electric part of the device.
Figure 3:
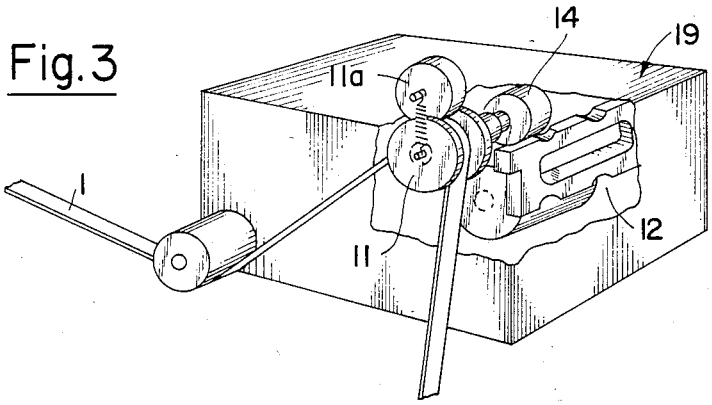
FIG. 3 is a perspective view of a second embodiment of the regulator.
Figure 4:
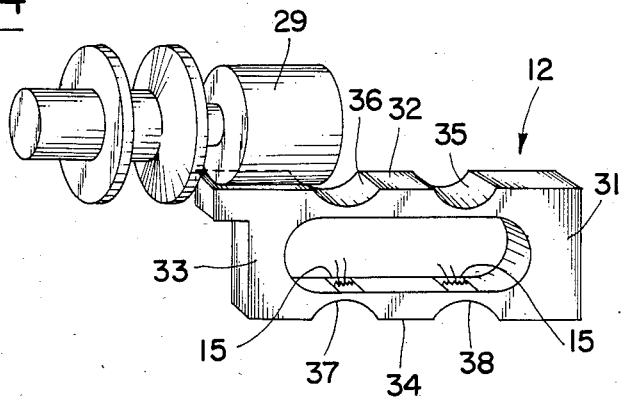
FIG. 4 is a perspective view on an enlarged scale of the bar of the device in question.
Figure 5:
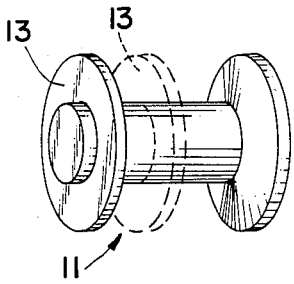
FIG. 5 is a perspective view on an enlarged scale of the pulley of the regulator.

The electrical signal produced by the electromechanical transducer, after being suitably processed as will be explained below, controls the driving of the electrical motor which in turn operates roller 3 or pulley 11 so that, when there is a greater flexure of the bar corresponding to a greater tensioning of the tape with respect to the established one, roller 3 or pulley 11 are actuated so as to feed tape and therefore reduce the tension; on the contrary, when there is a lesser flexure of the bar corresponding to a lesser tensioning of the tape with respect to the established one, roller 3 or pulley 11 are actuated so as to take up tape in order to return the tensioning to the established value. The electrical signal delivered by the transducer 8 is sent, through a filter block 20 and a preamplifier 21, to an electrical comparator 9 to which is also delivered a reference signal produced for example by a voltage generator. Three of these generators, identified at 23, 24 and 25 respectively, are shown in FIG. 2. They can be selected by means of a switch 22; in this way, if a reference signal is pre-established on each generator, either by normal setting or through an electronic processor, it is possible to execute three different types of pleating in timed sequence, owing to the fact that the elastic tape tensioning value and therefore the type of pleating depends upon the pre-selected value of the reference signal. Obviously, the number of generators can be whatever is desired.

Switch 22 can be actuated manually but it is generally actuated through an electronic processor which counts the number of stitches executed by the sewing machine and, once the machine has executed a certain number of stitches, actuates the switch 22 so as to vary the tension of the tape and therefore the pleating of the workpiece; as the tape tensioning on pulley 11 is kept constant, instead of counting the stitches, it is possible to provide an encoder 29 detecting the angular position of the pulley and converting it into a digital signal; this signal suitably processed is compared with preselected values so that it can not only actuate the switch 22 but also control other operations of the sewing machine (such as for example the starting or stopping of the motor, of the cutting device, etc.). In fact, the tension being constant, the number of revolutions of the pulley and therefore its angular position is proportional to the number of stitches made by the machine.

Comparator 9 delivers a command that is processed by an electrical processing means (of known type) diagrammatically shown at 10, which converts said command into a driving signal which is sent to the motor actuating roller 3 or pulley 11.

The body 19 of the regulator is integrally connected to and supported by one support 16 completely detached from the sewing machine; to said support 16 is also connected a second support 18 carrying the bobbin 5. Support 16 and all members connected thereto are completely detached from the sewing machine so that they do not feel the effects of possible vibrations that might alter the deformations produced on the mechanical part of the transducer 8.

OPERATION

The operation of the regulator takes place as described below.

The operator charged with the operation of the sewing machine selects one or more tape tensioning values by acting on generators 23, 24 and 25; one of these values is then chosen through switch 22.

The tape is introduced into the regulator which slakens or pulls the tape until the deformation produced on bar 12 gives an equilibrium signal between the preselected value and the actual value. When the stitching operation begins, the tape is pulled so that its tension increases; so the flexure of the bar increases too and therefore the transducer delivers a different signal with respect to the preceding equilibrium signal. Comparator 9, comparing the signal from the transducer with the reference signal coming from one of the generators, will therefore deliver a command which, once processed, operates the motor connected to roller 3 or pulley 11, so that it feeds tape to the machine bringing therefore the tape tension to the desired value.

If it is necessary to execute pleats of different types on the same garment workpiece, the operator will act successively on switch 22 which, as said before, can also be actuated automatically by a processor or by the above described encoder; so the tensioning value to be given to the tape can be modified at will.

The operation of the regulator is independent both of the type of tape used and of possible differences in elasticity at different points of the same tape; this is due to the fact that the tape tensioning value controls the feeding of the same and this value is maintained strictly constant during the stitching operation.

In addition, owing to the particular conformation of the transducer 8 bar, the operation of the regulator is independent of the position of the tape with respect to the point where the bar is fixedly restrained. This allows one to obtain perfectly identical garment workpieces, while this would not be possible acting manually or using the known devices as these methods neither ensure a constant tape tensioning nor allow an easy repetition of this tension; therefore it is not possible to obtain identical pleats.

The device of the invention also allows to pass readily from a tensioning value to another and therefore to obtain very defined limits on the same workpiece between a pleated portion and a smooth portion or between two differently pleated portions. Furthermore this device can be applied to any type of sewing machine and in whatever position with respect to the same; particularly, it can be applied upon, under or beside the machine.

Obviously the various structural and operational features disclosed are susceptible of a number of modifications and changes. For example, a mechanical hydraulic transducer or a mechanical pneumatic transducer could be used instead of an electromechanical transducer; then a torsional deformation produced on the driving pulley could be detected instead of a flexural deformation; this torsional deformation, which is converted into an electrical signal and processed as described above, could also be detected on a plane parallel to the axis of rotation of the sewing machine's motor so that it does not feel the effects of the vibrations caused by the inner crank mechanisms of the sewing machine; all that without departing from the spirit and scope of the invention as set forth in the appended claims.

What is claimed is:

1. A tension regulator for elastic tape and the like, suitable for use in sewing machines adapted to attach tape to a workpiece, comprising:

a pulley fitted to rotate about its own axis, located along the track of the tape between a tape feeding bobbin and the sewing machine's presser foot wherein said tape is wound about a part of the circumference of said pulley during its travel;

electromechanical transducer means to which the axis of rotation of said pulley is integrally connected and on which the stress caused by the tension of the tape acts, which is adapted to convert the deformation produced by said stress on its mechanical part into an electric signal;

motor means suitable to drivingly feed said tape to said presser foot, with respect to a tension force for the feed of tape depending upon the request from the sewing machine and said electric signal from said transducer means;

electric comparator means for comparing said electric signal from said transducer with a preselected reference signal and to deliver a command to a processor means; and processor means adapted to convert said command into a driving signal for said motor means.

2. A regulator according to claim 1, wherein said motor means comprises:

a pair of rollers disposed along the track of the tape between the feed bobbin and the pulley, which are urged into contact with each other and between which said tape is caused to pass;

an electric motor, actuated by said driving signal, operatively connected to at least one of said rollers to drivingly rotate the same.

3. A regulator according to claim 1, wherein said 35 motor means comprises an electric motor actuated by said driving signal, which is integrally connected to said electromechanical transducer and to the shaft of which said pulley is integrally connected.

4. A regulator according to claim 1, wherein said electromechanical transducer comprises:

a bar one end of which is fixedly restrained within the body of the regulator and the other end of which is free and bears the axis of rotation of said pulley which is integrally connected thereto; and an electrical measuring means located on said bar, adapted to detect the deformations and to convert them into an electrical signal.

5. A regulator according to claim 4, wherein said bar consists of four portions that are rigid when submitted to bending stresses and connected to each other by means of four further portions that are elastic if submitted to bending stresses so as to form all together an articulated quadrilateral, one of said rigid portions being fixedly restrained within the body of the regulator and the portion opposite thereto bearing the axis of rotation of said pulley; four electric strain gauge measuring means being provided, each of them connected to said bar in correspondence of an elastic portion thereof and the electrical signals of which are algebraically summed up; said algebraic sum forming the electrical signal sent to said electrical comparator.

6. A regulator according to claim 1, wherein said pulley exhibits a race defined by two flanks one of which is slidable in an axial direction thereby allowing the width of said race to be varied.

7. A regulator according to claim 1, further comprising: a number of generators producing electrical reference signals; a switch adapted to select one of said generators; an encoder connected to said pulley and suitable to convert the angular position thereof into a digital switching signal capable of controlling said switch.

8. A regulator according to claim 1, further comprising a support, completely detached from a sewing machine to which said regulator is applied, to this support being integrally connected said regulator and said tape feed bobbin.

* * * * *